US006952145B2

(12) United States Patent
Brown et al.

(10) Patent No.: US 6,952,145 B2
(45) **Date of Patent: *Oct. 4, 2005**

(54) TRANSVERSE MODE CONTROL IN A TRANSMISSION LINE

(75) Inventors: Stephen B. Brown, Palm Bay, FL (US); James J. Rawnick, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/614,149

(22) Filed: Jul. 7, 2003

(65) Prior Publication Data

US 2005/0007209 A1 Jan. 13, 2005

(51) Int. Cl.[7] ..... H01P 1/22
(52) U.S. Cl. ..... 333/81 B; 333/209
(58) Field of Search ..... 333/81 R, 81 B, 333/208, 209, 211

(56) References Cited

U.S. PATENT DOCUMENTS

| | | | | |
|---|---|---|---|---|
| 3,701,058 A | | 10/1972 | Smith | 333/159 |
| 4,604,592 A | * | 8/1986 | Pinson | 333/24.1 |
| 5,792,236 A | | 8/1998 | Taylor et al. | |
| 6,512,496 B2 | | 1/2003 | Alexeff et al. | 343/915 |
| 6,743,371 B2 | * | 6/2004 | John et al. | 252/62.52 |
| 2003/0160724 A1 | | 8/2003 | Alexeff et al. | 343/701 |
| 2004/0130497 A1 | | 7/2004 | Alexeff et al. | 343/725 |

OTHER PUBLICATIONS

U.S. Appl. No. 10/369,436, filed Feb. 18, 2003, Rawnick et al.
U.S. Appl. No. 10/387,208, filed Mar. 11, 2003, Rawnick et al.
U.S. Appl. No. 10/330,755, filed Dec. 27, 2002, Rawnick et al.
U.S. Appl. No. 10/330,754, filed Dec. 27, 2002, Rawnick et al.
U.S. Appl. No. 10/300,456, filed Nov. 19, 2002, Rawnick et al.
U.S. Appl. No. 10/361,548, filed Feb. 10, 2003, Rawnick et al.
U.S. Appl. No. 10/387,209, filed Mar. 11, 2003, Rawnick et al.
U.S. Appl. No. 10/439,094, filed May 15, 2003, Rawnick et al.
U.S. Appl. No. 10/387,194, filed Mar. 11, 2003, Brown et al.
U.S. Appl. No. 10/438,435, filed May 15, 2003, Brown et al.
U.S. Appl. No. 10/414,696, filed Apr. 16, 2003, Brown et al.
U.S. Appl. No. 10/637,027, filed Aug. 7, 2003, Brown et al.
U.S. Appl. No. 10/414,650, filed Apr. 16, 2003, Brown et al.
U.S. Appl. No. 10/635,629, filed Aug. 6, 2003, Brown et al.
U.S. Appl. No. 10/459,067, filed Jun. 11, 2003, Brown et al.

(Continued)

*Primary Examiner*—Stephen E. Jones
(74) *Attorney, Agent, or Firm*—Sacco & Associates, PA

(57) ABSTRACT

A waveguide apparatus (100) and method (300) of mode control can include a waveguide structure (102) defining at least one cavity (116) disposed within the waveguide apparatus. The waveguide apparatus has at least a first operational state in which at least one cavity is filled with a conductive fluid (126) and at least a second operational state in which at least one cavity is purged of the conductive fluid. The waveguide apparatus can further include at least one composition processor (150) adapted for changing at least one among an electrical characteristic and a physical characteristic of the waveguide apparatus by manipulating a volume of the conductive fluid and a controller (172) for controlling the composition processor in response to a transmission line mode control signal (174).

21 Claims, 5 Drawing Sheets

OTHER PUBLICATIONS

U.S. Appl. No. 10/438,436, filed May 15, 2003, Rawnick et al.
U.S. Appl. No. 10/635,582, filed Aug. 6, 2003, Rawnick et al.
U.S. Appl. No. 10/634,219, filed Aug. 5, 2003, Rawnick et al.
U.S. Appl. No. 10/458,859, filed Jun. 11, 2003, Rawnick et al.
U.S. Appl. No. 10/624,378, filed Jun. 22, 2003, Brown et al.
U.S. Appl. No. 10/438,433, filed May 15, 2003, Rawnick et al.
U.S. Appl. No. 10/460,947, filed Jun. 13, 2003, Rawnick et al.
U.S. Appl. No. 10/421,352, filed Apr. 23, 2003, Rawnick et al.
U.S. Appl. No. 10/409,261, filed Apr. 8, 2003, Pike.
U.S. Appl. No. 10/441,743, filed May 19, 2003, Pike.
U.S. Appl. No. 10/628,846, filed Jul. 28, 2003, Pike et al.
U.S. Appl. No. 10/448,973, filed May 30, 2003, Delgado et al.
U.S. Appl. No. 10/300,455, filed Nov. 19, 2002, Brown et al.
U.S. Appl. No. 10/330,756, filed Dec. 27, 2002, Rawnick et al.
U.S. Appl. No. 10/626,090, filed Jul. 24, 2003, Brown et al.
U.S. Appl. No. 10/632,632, filed Aug. 1, 2003, Rawnick et al.
U.S. Appl. No. 10/625,977, filed Jul. 24, 2003, Rawnick et al.
U.S. Appl. No. 10/620,483, filed Jul. 16, 2003, Brown et al.
U.S. Appl. No. 10/640,237, filed Aug. 13, 2003, Rawnick et al.
U.S. Appl. No. 10/648,913, filed Aug. 27, 2003, Brown et al.
U.S. Appl. No. 10/414,695, filed Apr. 16, 2003, Rawnick et al.
U.S. Appl. No. 10/421,305, filed Apr. 23, 2003, Rawnick et al.
U.S. Appl. No. 10/648,887, filed Aug. 27, 2003, Rawnick et al.

* cited by examiner

TRANSVERSE MODE CONTROL IN A TRANSMISSION LINE

BACKGROUND OF THE INVENTION

1. Statement of the Technical Field

The inventive arrangements relate generally to methods and apparatus for providing increased design flexibility for RF circuits, and more particularly to controlling modes within a transmission line.

2. Description of the Related Art

A waveguide is a transmission line structure that is commonly used for microwave signals. A waveguide typically includes a material medium that confines and guides a propagating electromagnetic wave. In the microwave regime, a waveguide normally consists of a hollow metallic conductor, usually rectangular, elliptical, or circular in cross section. This type of waveguide may, under certain conditions, contain a solid or gaseous dielectric material.

In a waveguide or cavity, a "mode" is one of the various possible patterns of propagating or standing electromagnetic fields. Each mode is characterized by frequency, polarization, electric field strength, and magnetic field strength. The electromagnetic field pattern of a mode depends on the frequency, refractive indices or dielectric constants, and waveguide or cavity geometry. With low enough frequencies for a given structure, no mode will be supported. At higher frequencies, higher modes are supported and will tend to limit the operational bandwidth of a waveguide. Each waveguide configuration can form different modes of operation. The easiest mode to produce is called the Dominant Mode. Other modes with different field configurations may occur accidentally or may be caused deliberately. Hence, it may be desirable to suppress certain higher modes by providing a particular waveguide structure that slightly attenuates in a desired mode while significantly attenuating an undesired mode or modes.

An "evanescent field" in a waveguide is a time-varying field having an amplitude that decreases monotonically as a function of transverse radial distance from the waveguide, but without an accompanying phase shift. The evanescent field is coupled, i.e., bound, to an electromagnetic wave or mode propagating inside the waveguide. In other words, an evanescent mode can be a signal below a cut-off frequency that propagates through the waveguide to a given extent and becomes weaker as it traverses through the waveguide.

Variable waveguide attenuators are commonly used to attenuate microwave signals propagating within a waveguide, which is a type of transmission line structure commonly used for microwave signals. Waveguides typically consist of a hollow tube made of an electrically conductive material, for example copper, brass, steel, etc. Further, waveguides can be provided in a variety of shapes, but most as previously mentioned often are cylindrical or have a rectangular cross section. In operation, waveguides propagate modes above a certain cutoff frequency.

Waveguide attenuators are available in a variety of arrangements. In one arrangement, the waveguide attenuator consists of three sections of waveguide in tandem: a middle section and two end sections. In each section a resistive film is placed across an inner diameter of the waveguide (in the case of a waveguide having a circular cross section) or across a width of the waveguide (in the case of a waveguide having a rectangular cross section). In either case, the resistive film collinearly extends the length of each waveguide section. The middle section of the waveguide is free to rotate radially with respect to the waveguide end sections. When the resistive film in the three sections are aligned, the E-field of the an applied microwave signal is normal to all films. When this occurs, no current flows in the films and no attenuation occurs. When the center section is rotated at an angle θ with respect to the end section at the input of the waveguide, the E field can be considered to split into two orthogonal components, E sin θ and E cos θ. E sin θ is in the plane of the film and E cos θ is orthogonal to the film. Accordingly, the E sin θ component is absorbed by the film and the E cos θ component is passed unattenuated to the end section at the output of the waveguide. The resistive film in the end section at the output then absorbs the E cos θ sin θ component of the E field and an E $\cos^2$ θ component emerges from the waveguide at the same orientation as the original wave. The accuracy of such an attenuator is dependant on the stability of the resistive films. If the resistive films should degrade over time, performance of the waveguide attenuator will be affected. Further, energy reflections and higher-order mode propagation commonly occur in such a waveguide attenuator design.

In another arrangement, a wedge shaped waveguide attenuator having resistive surfaces exists. Because the waveguide attenuator is wedge shaped, the E field again can be considered to split into two orthogonal components at each surface of the wedge, E sin θ and E cos θ. As with the previous example, the E sin θ component of a microwave signal is absorbed by the film. However, The tapered portion of the waveguide attenuator causes energy reflections to occur. Hence, the wedge shaped waveguide attenuator must be long enough to obtain sufficiently low reflection characteristics. Accordingly, this type of waveguide attenuator is limited to use in relatively long waveguides. Thus, a need exists for a waveguide and a waveguide attenuator that provides additional design flexibility and overcomes the limitations described above with respect to existing waveguides and waveguide attenuators.

A waveguide will have field components in the x, y, and z directions. A waveguide will typically have waveguide dimensions of width, height and length represented by a, b, and I respectively. There are no z-directed currents in the short walls of the waveguide (either for propagating mode or evanescent mode), so the short wall does not need to be continuous in the z-direction. Thus, an array of vertical (y-directed) wires would alternatively work as well. The cutoff frequency or cutoff wavelength (for transverse electric (TE) modes) can be represented as:

$$(f_c)_{mn} = \frac{1}{2\pi\sqrt{\mu\varepsilon}}\sqrt{\left(\frac{m\pi}{a}\right)^2 + \left(\frac{n\pi}{b}\right)^2}$$

and $$(\lambda_c)_{mn} = \frac{2}{\sqrt{\left(\frac{m}{a}\right)^2 + \left(\frac{n}{b}\right)^2}}$$

where a, b are waveguide dimensions as shown in FIG. 5, c is the speed of light, $\epsilon$ and $\mu$ describes the dielectric inside the waveguide and m, n are mode numbers. The lowest frequency mode $TE_{10}$ (m=1, n=0) is also known as the dominant mode and provides the most efficient mode for propagation. The dominant mode for rectangular waveguides is designated as the TE mode because the E fields are perpendicular to the "a" walls. The first subscript is 1 since there is only one half-wave pattern across the "a"

dimension. There are no E-field patterns across the "b" dimension, so the second subscript is 0. The complete mode description of the dominant mode in rectangular waveguides is $TE_{1,0}$. Waveguides are normally designed so that only the dominant mode will be used. To operate in the dominant mode, a waveguide must have an "a" (wide) dimension of at least one half-wavelength of the frequency to be propagated. In rectangular waveguides, the first subscript indicates the number of half-wave patterns in the "a" dimension, and the second subscript indicates the number of half-wave patterns in the "b" dimension. The "a" dimension of the waveguide must be kept near the minimum allowable value to ensure that only the dominant mode will exist. In practice, this dimension is usually 0.7 wavelength. The high-frequency limit of a rectangular waveguide is a frequency at which its "a" dimension becomes large enough to allow operation in a mode higher than that for which the waveguide has been designed. Thus, a need exists to dynamically adjust the dimension of a waveguide in certain scenarios.

The field arrangements of the various modes of operation are divided into two categories: Transverse electric (TE) and Transverse Magnetic (TM). In the transverse electric (TE) mode, the entire electric field is in the transverse plane, which is perpendicular to the length of the waveguide (direction of energy travel). Part of the magnetic field is parallel to the length axis. In the transverse magnetic (TM) mode, the entire magnetic field is in the transverse plane and has no portion parallel to the length axis. Since there are several TE and TM modes, subscripts are used to complete the description of the field pattern.

A similar system is used to identify the modes of circular waveguides. The general classification of TE and TM is true for both circular and rectangular waveguides. In circular waveguides the subscripts have a different meaning. The first subscript indicates the number of full-wave patterns around the circumference of the waveguide. The second subscript indicates the number of half-wave patterns across the diameter. In the circular waveguide, the E field is perpendicular to the length of the waveguide with no E lines parallel to the direction of propagation. Thus, it must be classified as operating in the TE mode. If you follow the E line pattern in a counterclockwise direction starting at the top, the E lines go from zero, through maximum positive (tail of arrows), back to zero, through maximum negative (head of arrows), and then back to zero again. This is one full wave, so the first subscript is 1. Along the diameter, the E lines go from zero through maximum and back to zero, making a half-wave variation. The second subscript, therefore, is also 1. $TE_{1,1}$ is the complete mode description of the dominant mode in circular waveguides. Several modes are possible in both circular and rectangular waveguides.

SUMMARY OF THE INVENTION

The present invention relates to a transmission lines and waveguides and methods for controlling modes therein. The waveguide includes at least one waveguide cavity and a conductive fluid at least partially disposed within at least one among the waveguide attenuator cavity and at least one subcavity within the waveguide cavity. At least one composition processor is included and adapted for changing at least one among an electrical characteristic and a physical characteristic of the waveguide by manipulating a volume of the conductive fluid. A controller is provided for controlling the composition processor in response to a transmission line mode control signal.

A plurality of component parts can be dynamically mixed together in the composition processor in response to the waveguide attenuator control signal to form the conductive fluid. The composition processor can include at least one proportional valve, at least one mixing pump, and at least one conduit for selectively mixing and communicating a plurality of the components of the conductive fluid from respective fluid reservoirs to a waveguide cavity or a subcavity of the waveguide cavity. The composition processor can further include a component part separator adapted for separating the component parts of the conductive fluid for subsequent reuse.

The component parts can be selected from the group consisting of (a) a low permittivity, low permeability, low loss component, (b) a high permittivity, low permeability, low loss component, and (c) a high permittivity, high permeability, high loss component. In another arrangement, the component parts can be selected from the group consisting of (a) a low permittivity, low permeability, low loss component, (b) a high permittivity, low permeability, low loss component, (c) a high permittivity, high permeability, low loss component, and (d) a low permittivity, low permeability, high loss component. The conductive fluid can include an industrial solvent which can have a suspension of magnetic particles contained therein. The magnetic particles can consist of ferrite, metallic salts, and organo-metallic particles. In one arrangement, waveguide cavity can contain about 50% to 90% magnetic particles by weight.

In another aspect of the invention, a method of controlling the mode of a transmission line comprises the steps of providing at least one waveguide filter cavity within a waveguide, at least partially filling the waveguide filter cavity with a conductive fluid, propagating the RF signal within the waveguide, and changing at least a volume of the conductive fluid to selectively vary at least one of a physical dimension of the waveguide or an electrical dimension of the RF signal in response to a waveguide mode control signal.

DETAILED DESCRIPTION OF THE PREFERRED EMBODIMENTS

The present invention provides the circuit designer with an added level of flexibility by permitting a conductive fluid to be used in a waveguide, thereby enabling the manipulation of physical dimensions as well as electrical characteristics such as attenuation and impedance characteristics of the waveguide. Particles having a high loss tangent can be provided in the conductive fluid and the particle density can be adjusted to vary the attenuation. For example, particles made of ferrite or iron powder. Further, the permittivity ($\epsilon$) and/or permeability ($\mu$) of the conductive fluid can be adjusted to change the impedance of the waveguide or to maintain a constant impedance as the particle density is adjusted. For example, the impedance of the waveguide attenuator can be precisely matched to the impedance of a waveguide by maintaining a constant ratio of $\epsilon_r/\mu_r$, where $\epsilon_r$ is the relative permittivity of the fluidic dielectric, and $\mu_r$ is the relative permeability of the fluidic dielectric. A precisely matched impedance can minimize energy reflections caused by a transition from an unattenuated portion of the waveguide to a waveguide attenuator for example. A precisely matched impedance also reduces higher-order mode propagation. The volume and/or shape of the waveguide attenuator can also be adjusted using fluidics. In other words, a dielectric fluid can be used to alter the electrical size while a conductive fluid could be used alter the physical size or shape of the waveguide attenuator to provide tunable cut-off frequencies, attenuators, filters as well as mode control or suppression.

Figure 1:
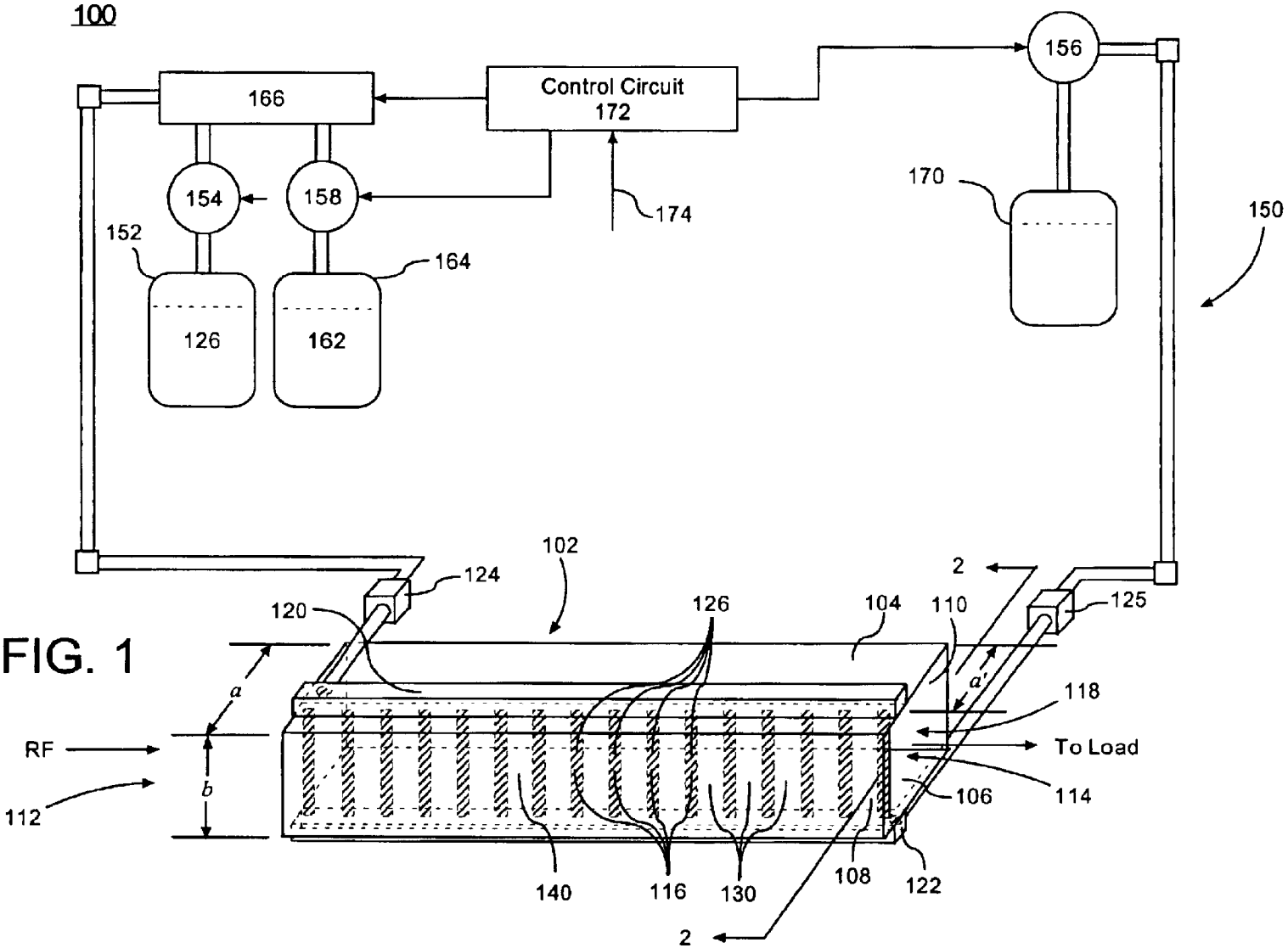
FIG. 1 is a block diagram useful for understanding the waveguide of the present invention.
Figure 2:
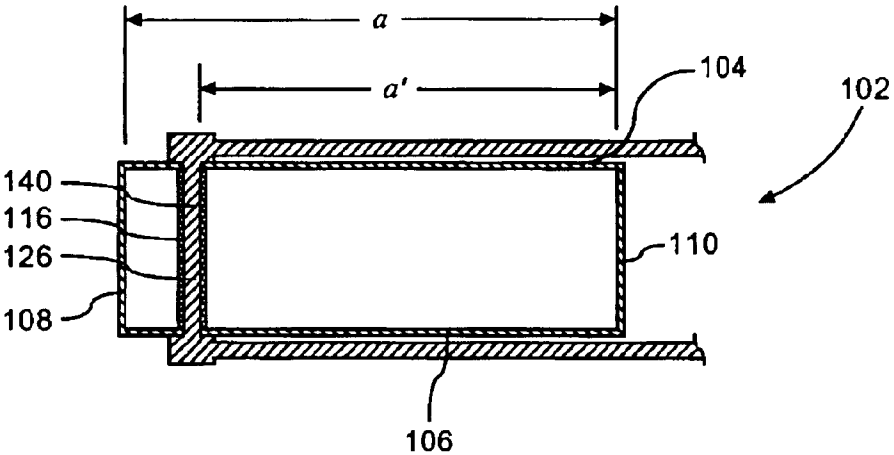
FIG. 2 is a cross-sectional view of the waveguide of FIG. 1, taken along line section line 2—2.

FIG. 1 is a conceptual diagram that is useful for understanding the mode controlled waveguide of the present invention. In FIG. 1, a waveguide tuning apparatus 100 is presented which includes a waveguide 102. The waveguide 102 can be a tubular structure having at least one wall, an input opening 112 and an output opening 114. At this point it should be noted that the present invention is not limited to any particular waveguide structure. In particular, the present invention can be used with waveguides having any configuration or shape. In one arrangement, the waveguide can have a rectangular cross section. For example, the waveguide can have opposing waveguide walls 104, 106 having a width a and opposing waveguide walls 108, 110 having a width b, thereby defining a waveguide dielectric region 118 within the waveguide walls 104, 106, 108, 110. A cross-sectional view of the variable waveguide in FIG. 1, taken along line section 2—2, is shown in FIG. 2.

One or more fluid conduits 116 having cavities can extend from wall 104 to wall 106. The fluid conduits 116 can be any conduit that can contain a conductive fluid 126 so that electrical continuity can be provided between wall 104 and wall 106 at the location of the fluid conduit when the conductive fluid 126 is present. In particular, the fluid conduits 116 can be channels, tubes, elongated cavities, or any other type of dielectric cavity which extends from a first portion of the waveguide to a second portion of the waveguide. For example, the fluid conduits 116 can extend between portions of two or more waveguide walls. The fluid conduits 116 can be glass, plastic, ceramic or any other dielectric material which can contain the conductive fluid 126 within the fluid conduits 116.

In one arrangement, where a dielectric material is disposed between the walls 104, 106, the fluid conduits 116 can be a bore or via that extends from wall 104, through the dielectric to wall 106. In another arrangement, the bore can extend through the walls 104, 106 as well. Moreover, the fluid conduits 116 can extend from, or to, any of the waveguide walls, and the fluid conduits 116 can be disposed to create differing waveguide structures. Still, there are a myriad of conduits and conduit configurations that can be used, all of which are intended to be included within the scope of the invention.

In a first operational state, the conductive fluid 126 can be injected into the fluid conduits 116 to create a plurality of conductive regions which create an effective waveguide wall (effective wall) 140 extending between the walls 104, 106 and located in a region defined by the plurality of fluid conduits 116. For example, the effective wall 140 can be parallel to, and located inward from, walls 108, 110. Accordingly, the waveguide can be defined to be bounded by walls 104, 106, 110 and the effective waveguide wall. In consequence, the effective width a of the waveguide walls 104, 106 is reduced to $\alpha'$.

As noted, in the $TE_{10}$ mode the equation for signal wavelength ($\lambda_c$) at the cutoff frequency ($f_c$) reduces to $\lambda_c$=2a. Hence, the reduction in the effective width of waveguide walls 104, 106 reduces the signal wavelength at the cutoff frequency, and thus increases $f_c$. Also, the attenuation of the waveguide below $f_c$ is given by.

$$\alpha = 54.6\frac{l}{\lambda_c}\sqrt{1-\left(\frac{f}{f_c}\right)^2}.$$

The increase in $f_c$ and the decrease in $\lambda_c$ caused by the effective narrowing of the walls 104, 106 each contribute to an increase in waveguide attenuation below $f_c$. Accordingly, the conductive fluid 126 can be injected into the fluid conduits 116 to change $f_c$, $\lambda_c$, or vary waveguide attenuation below $f_c$.

The skilled artisan will appreciate that power currents in the waveguide are propagated from the input opening 112 towards the output opening 114 via walls 104, 106. In particular, the power currents are generated from electric fields which are formed between walls 104, 106. Notably, power currents do not typically propagate from the input opening 112 towards the output opening 114 on the narrower waveguide walls, which in this case are wall 108 and the effective wall 140 (when fluid conduits 116 are filled with conductive fluid 126), because in general electric fields do not form between these walls. Accordingly, gaps 130 in the effective wall 140 between fluid conduits 116 do not adversely affect waveguide performance.

A third waveguide also can be defined which is bounded by walls 104, 106, 108 and the effective wall 140. In the case that the width (a–a') between wall 108 and the effective wall 140 is greater than width b, the third waveguide will operate as previously discussed, except that $\lambda_c$=2(a–a'). In the case that width (a–a') is less than width b, the signal wavelength at the cutoff frequency for the third waveguide then becomes $\lambda_c$=2b. In such a configuration the effective wall 140 will be one of the walls having the greatest width. Gaps 130 will adversely affect propagation for power currents in such an arrangement.

In a second operational state, the conductive fluid 126 can be purged from the fluid conduits 116, thereby removing the effective wall 140. For example, a vacuum or positive pressure can be used to purge the conductive fluid 126 from the fluid conduits 116. In one arrangement, the conductive fluid 126 can be replaced with a fluid dielectric 162 or a gas. The fluid dielectric or gas can be any fluid or gas which can be injected in the fluid conduits 116 to remove the conductive fluid 126 from the fluid conduits. For example, a typical fluid dielectric can be an oil, such as Vacuum Pump Oil MSDS-12602 or a solvent, such as formamide, water, etc. Typical gases can include air, nitrogen, helium, and so on. Importantly, the invention is not limited to any particular fluid dielectric 162 or gas. Those skilled in the art will recognize that the examples of fluid dielectric or gas as disclosed herein are merely by way of example and are not intended to limit in any way the scope of the invention.

Figure 3A:
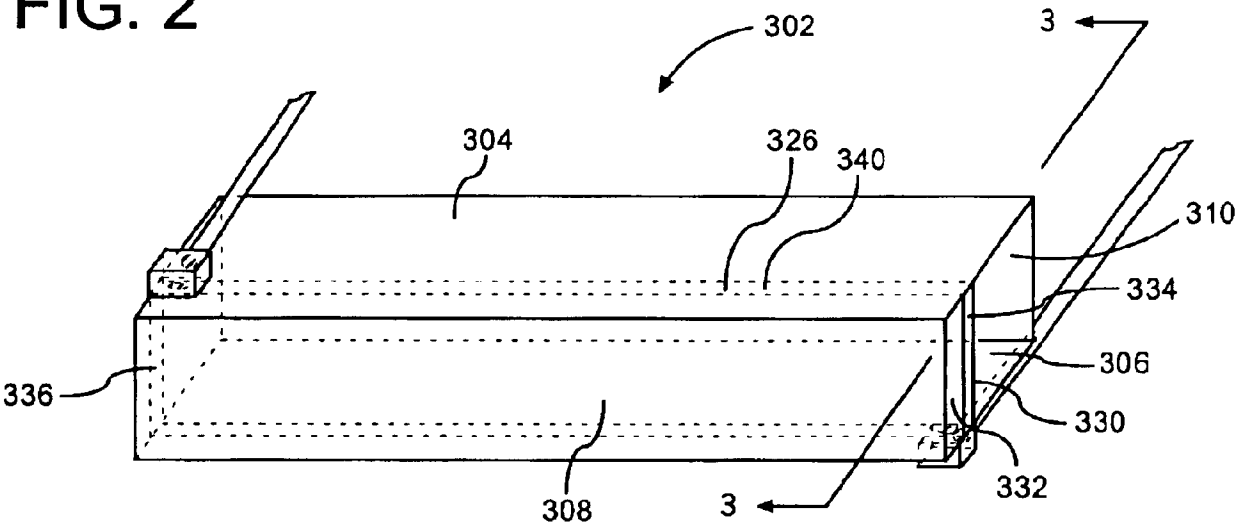
FIG. 3A is a conceptual diagram of an alternate embodiment of the waveguide in accordance with the present invention.
Figures 3B, 3C:
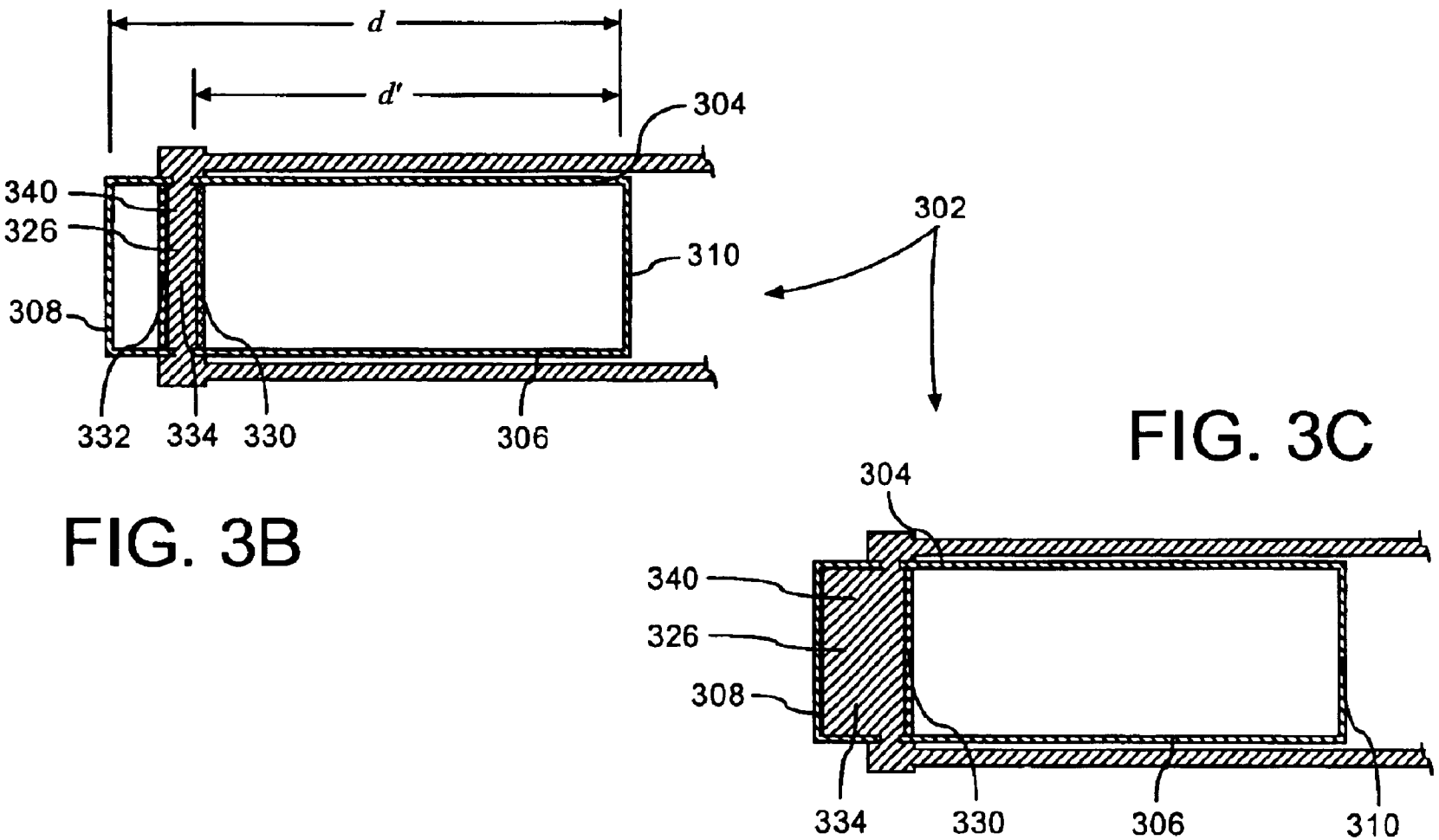
FIG. 3B is a cross-sectional view of the waveguide of FIG. 3A, taken along line section line 3—3.
FIG. 3C is a cross-sectional view of another arrangement of the waveguide of FIG. 3A, taken along line section line 3—3.

Referring to FIG. 3A, an alternative embodiment for a waveguide 302 is shown wherein dielectric walls define a cavity 340 within waveguide 302. A cross-sectional view taken along section lines 3—3 is shown in FIG. 3B. The cavity 340 is bounded by waveguide walls 304, 306 and dielectric walls 330, 332, 334, 336. The dielectric walls can be glass, plastic, or any other dielectric material which can prevent leakage of the conductive fluid 326 from the cavity 340. Accordingly, the dielectric walls 330, 332, 334, 336 will maintain the conductive fluid 326 within the cavity 340, while having an insignificant impact on waveguide performance when the conductive fluid 326 is not present in the cavity 340.

The conductive fluid 326 can be injected into the cavity 340 during the first operational state to define an effective wall 140 in the cavity region which reduces the effective width of walls 304, 306 from d to d', as measured from wall 310. Accordingly, $\lambda_c$ is decreased and $f_c$ is increased which, as noted, increases attenuation below $f_c$. Again, a third waveguide is defined which is bounded by walls 304, 306, 308 and the effective wall 140. In this arrangement, however, the effective wall 140 is continuous, and thus can be used to propagate power currents. Alternatively, cavity 340 can be defined by waveguide walls 304, 306, 308 and dielectric walls 330, 334, 336 (without the use of dielectric wall 332), as shown in FIG. 3C. Accordingly, the cavity 340 can be completely filled with conductive fluid 326 so that a third waveguide is not created when the conductive fluid 326 is present.

Fluid Control System

Referring once again to FIG. 1, it can be seen that the invention preferably includes a fluid control system 150 for selectively controlling the presence and/or removal of the conductive fluid 126 from the fluid conduits 116. The fluid control system 150 also can be used for selectively controlling the presence and/or removal of the conductive fluid 126 or 326 from the cavity 134 of FIG. 3A. However, for convenience, the operation of the fluid control system shall be described relative to FIGS. 1 and 2. The fluid control system can comprise any suitable arrangement of pumps, valves and/or conduits that are operable for effectively injecting and/or removing the conductive fluid 126. A wide variety of such fluid control systems may be implemented by those skilled in the art. For example, in one embodiment, the fluid control system can include a reservoir 152 for the conductive fluid 126 and a pump 154 for injecting the conductive fluid 126 into the fluid conduits 116.

The conductive fluid 126 can be injected into the fluid conduits 116 (or cavity 134 of FIG. 3A) by means of a suitable fluid transfer conduit 120. A second fluid transfer conduit 122 can also be provided for permitting the conductive fluid 126 to be purged from the fluid conduits 116 so that the conductive fluid 126 does not provide an effective wall 140. Further, fluid valves 124, 125 can be provided between the fluid transfer conduits 120, 122 and the fluid conduits 116. The fluid valves 124, 125 can be closed to contain the conductive fluid 126 within the fluid conduits 116 during the first operational state, and opened when the conductive fluid 126 is purged from the fluid conduits 116. In one embodiment the fluid valves 124, 125 can be mini-electromechanical or micro-electromechanical systems (MEMS) valves, which are known to the skilled artisan.

When it is desired to purge the conductive fluid 126 from the fluid conduits 116, a pump 156 can be used to draw the conductive fluid 126 from the fluid conduits 116 into reservoir 170. Alternatively, in order to ensure a more complete removal of all conductive fluid from the fluid conduits 116, one or more pumps 158 can be used to inject a dielectric solvent 162 into the fluid conduits 116. The dielectric solvent 162 can be stored in a second reservoir 164 and can be useful for ensuring that the conductive fluid 126 is completely and efficiently flushed from the fluid conduits 116. A control valve 166 can be used to selectively control the flow of conductive fluid 126 and dielectric solvent 162 into the fluid conduits 116. A mixture of the conductive fluid 126 and any excess dielectric solvent 162 that has been purged from the fluid conduits 116 can be collected in a recovery reservoir 170. For convenience, additional fluid processing, not shown, can also be provided for separating dielectric solvent from the conductive fluid contained in the recovery reservoir for subsequent reuse. However, the additional fluid processing is a matter of convenience and not essential to the operation of the invention.

A control circuit 172 can be configured for controlling the operation of the fluid control system 150 in response to an analog or digital fluid or mode control control signal 174. For example, the control circuit 172 can control the operation of the various valves 120, 122, 166, and pumps 154, 156, 158 necessary to selectively control the presence and removal of the fluid dielectric 126 and the dielectric solvent 162 from the fluid conduits 116. It should be understood that the fluid control system 150 is merely one possible implementation among many that could be used to inject and purge conductive fluid from the fluid conduits 116 and the invention is not intended to be limited to any particular type of fluid control system. All that is required of the fluid control system is the ability to effectively control the presence and removal of the conductive fluid 126 from the fluid conduits 116.

Composition of Conductive Fluid

High levels of magnetic permeability are commonly observed in magnetic metals such as Fe and Co. For example, solid alloys of these materials can exhibit levels of $\mu_r$ in excess of one thousand. By comparison, the permeability of fluids is nominally about 1.0 and they generally do not exhibit high levels of permeability. However, high permeability can be achieved in a fluid by introducing metal particles/elements to the fluid. For example typical magnetic fluids comprise suspensions of ferro-magnetic particles in a conventional industrial solvent such as water, toluene, mineral oil, silicone, and so on. Other types of magnetic particles include metallic salts, organo-metallic compounds, and other derivatives, although Fe and Co particles are most common. The size of the magnetic particles found in such systems is known to vary to some extent. However, particles sizes in the range of 1 nm to 20 $\mu$m are common. The composition of particles can be varied as necessary to achieve the required range of permeability in the final mixed fluidic dielectric after mixing. However, magnetic fluid compositions are typically between about 50% to 90% particles by weight. Increasing the number of particles will generally increase the permeability.

An example of a set of component parts that could be used to produce a conductive fluid as described herein would include oil (low permittivity, low permeability and low loss), a solvent (high permittivity, low permeability and low loss), and a magnetic fluid, such as combination of an oil and a ferrite (low permittivity, high permeability and high loss). Further, certain ferrofluids also can be used to introduce a high loss tangent into the conductive fluid, for example those commercially available from FerroTec Corporation of Nashua, N.H. 03060. In particular, Ferrotec part numbers EMG0805, EMG0807, and EMG1111 can be used. A hydrocarbon dielectric oil such as Vacuum Pump Oil MSDS-12602 could be used to realize a low permittivity, low permeability, and low loss tangent fluid. A low permittivity, high permeability fluid may be realized by mixing the hydrocarbon fluid with magnetic particles or metal powders which are designed for use in ferrofluids and magnetorestrictive (MR) fluids. For example magnetite magnetic particles can be used. Magnetite is also commercially available from FerroTec Corporation. An exemplary metal powder that can be used is iron-nickel, which can be provided by Lord Corporation of Cary, N.C. Fluids containing electrically conductive magnetic particles require a mix ratio low enough to ensure that no electrical path can be created in the mixture. Additional ingredients such as surfactants can be included to promote uniform dispersion of the particles. High permittivity can be achieved by incorporating solvents such as formamide, which inherently posses a relatively high permittivity. Fluid Permittivity also can be increased by adding high permittivity powders such as Barium Titanate manufactured by Ferro Corporation of Cleveland, Ohio. For broadband applications, the fluids would not have significant resonances over the frequency band of interest.

The fluidic dielectric can be comprised of several component parts that can be mixed together to produce a desired propagating mode as well as attenuation, permittivity and permeability required for particular waveguide attenuator characteristics. In this regard, it will be readily appreciated that fluid miscibility and particle suspension are key considerations to ensure proper mixing. Another key consideration is the relative ease by which the component parts can be subsequently separated from one another. The ability to separate the component parts is important when the attenuation or impedance requirements change. Specifically, this feature ensures that the component parts can be subsequently re-mixed in a different proportion to form a new conductive fluid.

It may be desirable in many instances to select component mixtures that produce a conductive fluid that has a relatively constant response over a broad range of frequencies. If the conductive fluid is not relatively constant over a broad range of frequencies, the characteristics of the fluid at various frequencies can be accounted for when the conductive fluid is mixed. For example, a table of loss tangent, permittivity and permeability values vs. frequency can be stored in the controller for reference during any mixing process.

Aside from the foregoing constraints, there are relatively few limits on the range of component parts that can be used to form the conductive fluid. Accordingly, those skilled in the art will recognize that the examples of component parts, mixing methods, volume distribution methods, and separation methods as shall be disclosed herein are merely by way of example and are not intended to limit in any way the scope of the invention. Also, the component materials are described herein as being mixed in order to produce the conductive fluid. However, it should be noted that the invention is not so limited. Instead, it should be recognized that the composition of the conductive fluid could be modified in other ways. For example, the component parts could be selected to chemically react with one another in such a way as to produce the conductive fluid with the desired values of permittivity and/or permeability. All such techniques will be understood to be included to the extent that it is stated that the composition or volume of the conductive fluid is changed.

A nominal value of permittivity ($\epsilon_r$) for fluids is approximately 2.0. However, the component parts for the conductive fluid can include fluids with extreme values of permittivity. Consequently, a mixture of such component parts can be used to produce a wide range of intermediate permittivity values. For example, component fluids could be selected with permittivity values of approximately 2.0 and about 58 to produce a conductive fluid with a permittivity anywhere within that range after mixing. Dielectric particle suspensions can also be used to increase permittivity and loss tangent.

According to a preferred embodiment, the component parts of the conductive fluid can be selected to include (a) a low permittivity, low permeability, low loss component and (b) a high permittivity, high permeability, high loss component. These two components can be mixed as needed for increasing the loss tangent while maintaining a relatively constant ratio of permittivity to permeability. A third component part of the conductive fluid can include (c) a high permittivity, low permeability, low loss component for allowing adjustment of the permittivity of the fluidic dielectric independent of the permeability. Still, a myriad of other component mixtures can be used. For example, the following conductive fluid components can be provided: (a) a low permittivity, low permeability, low loss component, (b) a high permittivity, low permeability, low loss component, (c) a high permittivity, high permeability low loss component, and (d) a low permittivity, low permeability, high loss component.

Multiple Effective Walls

In the most basic form, the invention can be implemented using a single cavity or a single row of fluid conduits as illustrated in FIGS. 1–3C. However, those skilled in the art will readily appreciate that the invention is not so limited. An exemplary waveguide can also comprise a plurality of rows of fluid conduits that can be used to adjust the performance characteristics of the waveguide. Notably, any number of rows of fluid conduits can be provided. The rows can be disposed to provide effective walls in various regions of the waveguide. For example, certain rows can provide varying width adjustment for the waveguide which can be useful for changing the cutoff frequency of the waveguide. Further, rows of fluid conduits can provide length adjustment for the waveguide, which can be useful for changing the attenuation of the waveguide below the waveguide cutoff frequency.

At this point it should be noted that the arrangement shown in FIGS. 1–3 is for exemplary purposes and a variety of arrangements can be provided wherein a conductive fluid can be used to change the effective dimensions of a waveguide, all of which are within the scope of the present invention. As noted, the fluid control system can comprise any suitable arrangement of pumps, valves and conduits that are operable for effectively injecting and removing conductive fluid (126, 226, or 326), or any other fluid or gas, from the fluid conduits (116). For example, the fluid control system can include reservoirs and control valves to inject the conductive fluid or fluid dielectric in the appropriate fluid conduit. Suitable fluid pumps (not shown) and fluid transfer conduits also can be provided in the fluid control system to facilitate injection of conductive fluid into fluid conduits. Further, fluid transfer conduits and an appropriate pump (not shown) can be provided to remove the conductive fluid or fluid dielectric from the fluid conduits.

Referring once again to FIG. 1, the waveguide cavity is filled with a conductive fluid to primarily alter the physical dimensions of the waveguide and alternatively to vary attenuation characteristics, permittivity and/or permeability of the waveguide by either changing the composition or volume of conductive fluid within the cavity region. The waveguide 102 can be any structure capable of supporting propagation modes and not limited to the rectangular structure shown. Waveguides are commonly embodied as electrically conductive tubes having circular or rectangular cross sections, but the present invention is not so limited; the present invention can be incorporated into any type of waveguide having any desired shape. For example, the present invention can be incorporated into a waveguide comprising circuit traces on a dielectric substrate and a plurality of rows of conductive vias which cooperatively support propagation modes. In such an example, at least one cavity for containing conductive fluid can be positioned between adjacent rows of conductive vias. Additional vias having one end which couples to the cavity can be provided as a pathway for the flow of fluidic dielectric in and out of the cavity.

As noted in the previous examples, the cavity region of the waveguide can comprise adjustable barriers and/or other objects which can change the RF response of the waveguide. Likewise, the control of volume of conductive fluid within the cavity region or regions can also alter the response of the waveguide. In particular, changing the dimensions and/or volume of fluid within the cavity region can change the frequency of modes supported within cavity region. Ideally, a conductive fluid can be placed in the cavity region to minimize attenuation of a dominant mode while attenuating all other higher order modes. Alternatively, the conductive fluid could be placed in the cavity region such that a particular higher order mode is left primarily unattenuated while all other higher order modes and the dominant mode is attenuated to provide a notched response.

Figure 4:
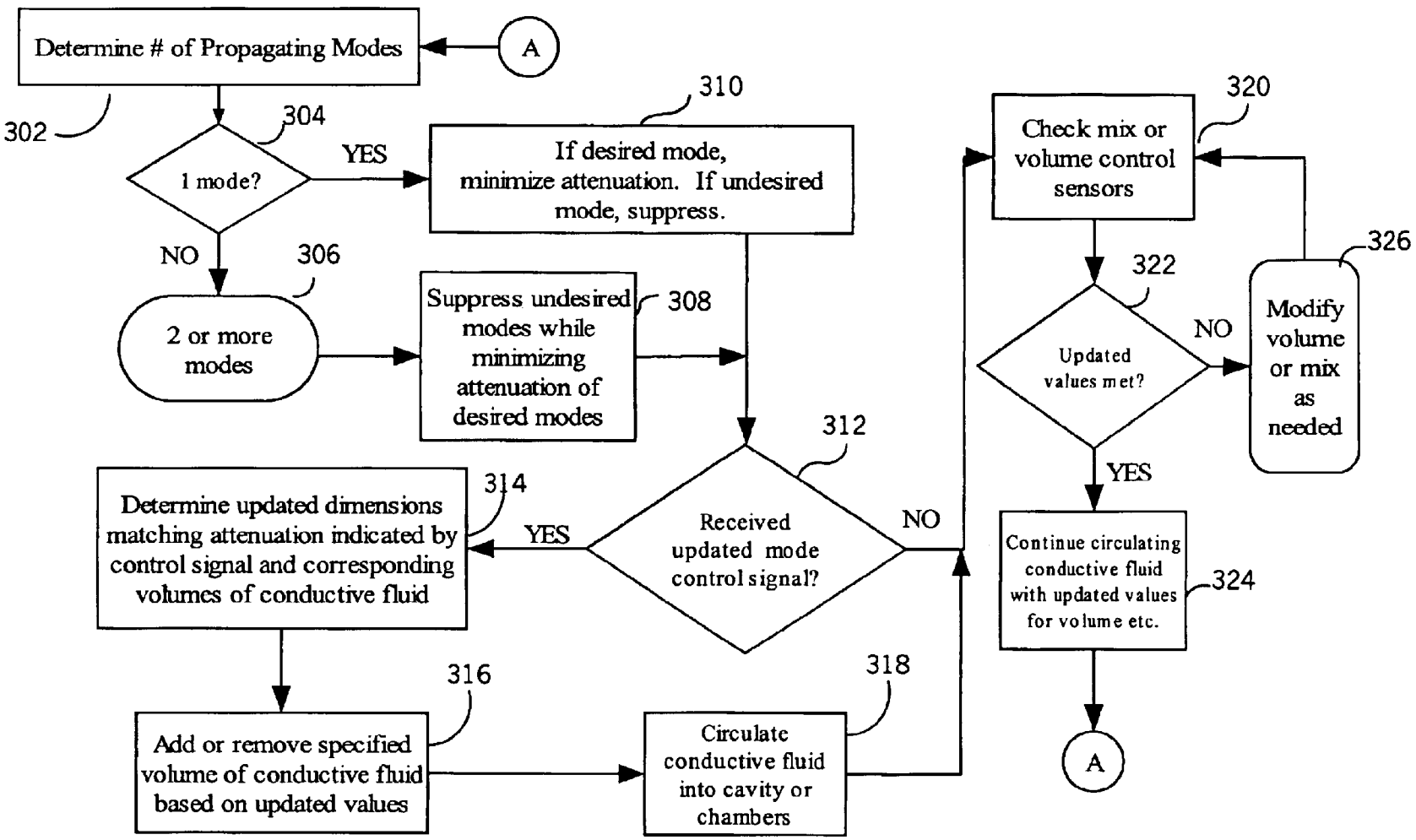
FIG. 4 is a flow chart that is useful for understanding a process in accordance with the invention.
Figure 5:
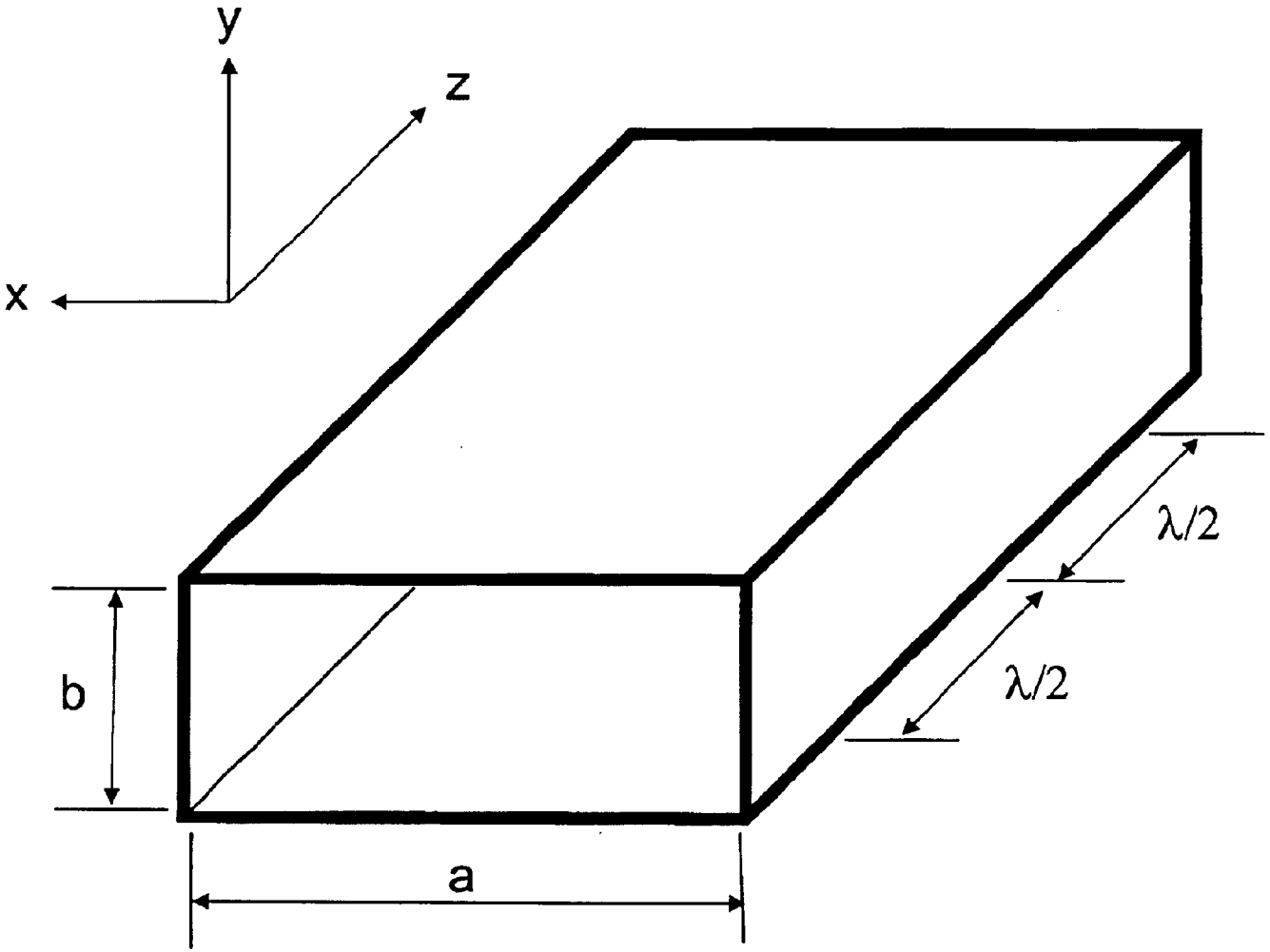
FIG. 5 is a rectangular waveguide for understanding the concept of control mode in accordance with the present invention.

The operation of the composition processor can be described in greater detail with reference to FIG. 1 and the flowchart shown in FIG. 4. The process can begin in step 302 of FIG. 4 where it is determined (apriori, if needed) how many modes will propagate for a given structure and signal. If a single mode is determined to propagate at decision block 304, then attenuation for the given mode is minimized unless the single mode is undesired for a particular application at step 310. If the mode is undesired, then it can be suppressed. If more than one mode is found at decision block 304, then two or more higher order modes are indicated at block 304. In such instance, undesired modes (typically the higher order modes) are suppressed while desired modes (typically the dominant mode) have minimized attenuation at step 308. At step 312, controller 136 checks to see if an updated waveguide mode control signal 174 has been received on an input line of the control circuit 172. If no updated signal is provided at decision block 312, then volume and/or mix (composition) sensors can be checked at block 320. If an updated mode control signal is received at decision block 312, then the process continues on to step 314 to determine updated dimensions matching attenuation indicated by the waveguide mode control signal 174 and corresponding to specified volumes and/or shapes of conductive fluid. The updated values necessary for achieving the indicated attenuation and/or volumes can be determined using a look-up table. At step 316, specific volumes of conductive fluids can be added or removed based upon the updated values. At step 318, conductive fluid would then be circulated as needed into the appropriate cavities, subcavities or chambers of the waveguide. Subsequently the volume and/or mix sensor are checked at step 320. If the updated values are met at decision block 322, the conductive fluids continue to be circulated as needed with the updated values in the appropriate chambers or cavities at step 324 and the process returns to the beginning. If the updated values have not been met at decision block 322, then volumes or mixtures of the conductive fluid are modified as needed to meet the indicated updated values at step 326, whereupon sensors are checked at step 320 until the updated values are met.

In step 316, the controller can determine an updated permittivity value for matching the characteristic impedance indicated by the waveguide mode control signal 174. For example, the controller 172 can determine the permeability of the fluidic components based upon the fluidic component mix ratios and determine an amount of permittivity that is necessary to achieve the indicated impedance for the determined permeability.

The composition processor or fluid control system 150 can manipulate specified volumes of fluidic dielectric or conductive fluid to or from one or more cavities or chambers within the waveguide to compensate for the previously determined updated values. Alternatively or in conjunction with altering volumes, the controller 174 can cause the composition processor or fluid control system 150 to begin mixing two or more component parts in a proportion to form fluidic dielectric that has the updated loss tangent and permittivity values determined earlier. In the case that the high loss component part also provides a substantial portion of the permeability in the conductive fluid, the permeability will be a function of the amount of high loss component part that is required to achieve a specific attenuation. However, in the case that a separate high permeability fluid is provided as a high permeability component part, the permeability can be determined independently of the loss tangent. This mixing process and/or volume shifting can be accomplished by any suitable means. For example, in FIG. 1 a set of proportional valves and mixing pumps can be used to mix component parts from reservoirs appropriate to achieve the desired updated loss tangent, permittivity and permeability values.

In step 320, the controller can check one or more sensors to determine if the conductive fluid being circulated through the cavity has the proper values of loss tangent, permittivity and permeability or to determine proper volumes corresponding to the previously determined updated values. Sensors (not shown) can include inductive type sensors capable of measuring permeability as well as capacitive type sensors capable of measuring permittivity. Other sensors such as flow meters can be used to determine volumes.

Significantly, when updated conductive fluid is required, any existing conductive fluid should be circulated out of the waveguide cavity. Any existing conductive fluid not having the proper loss tangent and/or permittivity can be deposited in a collection reservoir. The conductive fluid deposited in the collection reservoir can thereafter be re-used directly by mixing with other fluids or separated out into its component parts so that it may be re-used at a later time to produce additional conductive fluid. The aforementioned approach includes a method for sensing the properties of the collected fluid mixture to allow the fluid processor to appropriately mix the desired composition, and thereby, allowing a reduced volume of separation processing to be required. For example, the component parts can be selected to include a first fluid made of a high permittivity solvent completely miscible with a second fluid made of a low permittivity oil that has a significantly different boiling point. A third fluid component can be comprised of a ferrite particle suspension in a low permittivity oil identical to the first fluid such that the first and second fluids do not form azeotropes. Given the foregoing, the following process may be used to separate the component parts. Those skilled in the art will recognize that the specific process used to separate the component parts from one another will depend largely upon the properties of materials that are selected and the invention. Accordingly, the invention is not intended to be limited to the particular process outlined above.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A mode controlled transmission line, comprising:

a waveguide;

a structure at least partially formed of a dielectric material defining at least one cavity disposed within said waveguide;

a conductive fluid, wherein said waveguide has at least a first operational state in which said at least one cavity is filled with said conductive fluid and at least a second operational state in which said at least one cavity is purged of said conductive fluid;

at least one fluid processor adapted for changing at least one among an electrical characteristic and a physical characteristic of the mode controlled transmission line by manipulating a volume of said conductive fluid; and a controller for controlling said fluid processor in response to a transmission line mode control signal.

2. The mode controlled transmission line according to claim 1 wherein said transmission line has a first cutoff frequency in said first operational state and a second cutoff frequency different from said first cutoff frequency in said second operational state.

3. The mode controlled transmission line according to claim 1 further comprising a fluid control system for transferring said conductive fluid into and out of said at least one cavity responsive to a control signal.

4. The mode controlled transmission line according to claim 1 wherein said conductive fluid is comprised of an industrial solvent having a suspension of magnetic particles contained therein.

5. The mode controlled transmission line according to claim 4 wherein said magnetic particles are formed of a material selected from the group consisting of ferrite, metallic salts, and organo-metallic particles.

6. A mode controlled transmission line, comprising:

a waveguide;

a structure defining at least one cavity disposed within said waveguide;

a conductive fluid, wherein said waveguide has at least a first operational state in which said at least one cavity is filled with said conductive fluid and at least a second operational state in which said at least one cavity is purged of said conductive fluid;

at least one composition processor adapted for changing at least one among an electrical characteristic and a physical characteristic of the mode controlled transmission line by manipulating a volume of said conductive fluid;

a controller for controlling said composition processor in response to a transmission line mode control signal; and wherein said waveguide has a first electrical length in said first operational state and a second electrical length different from said first electrical length in said second operational state.

7. A mode controlled transmission line, comprising:

a waveguide;

a structure defining at least one cavity disposed within said waveguide;

a conductive fluid, wherein said waveguide has at least a first operational state in which said at least one cavity is filled with said conductive fluid and at least a second operational state in which said at least one cavity is purged of said conductive fluid;

at least one composition processor adapted for changing at least one among an electrical characteristic and a physical characteristic of the mode controlled transmission line by manipulating a volume of said conductive fluid;

a controller for controlling said composition processor in response to a transmission line mode control signal; and wherein said structure is a dielectric structure comprised of at least a first solid dielectric wall extending from a first conductive wall of said waveguide to a second conductive wall of said waveguide, said second conductive wall being spaced from said first conductive wall.

8. The mode controlled transmission line according to claim 7 wherein said cavity is defined between said first dielectric wall and at least one conductive wall of said transmission line.

9. The mode controlled transmission line according to claim 7 wherein said dielectric structure is further comprised of a second dielectric wall, and said cavity is defined between said first and second dielectric walls.

10. A mode controlled transmission line, comprising:

a waveguide;

a structure defining at least one cavity disposed within said waveguide;

a conductive fluid, wherein said waveguide has at least a first operational state in which said at least one cavity is filled with said conductive fluid and at least a second operational state in which said at least one cavity is purged of said conductive fluid;

at least one composition processor adapted for changing at least one among an electrical characteristic and a physical characteristic of the mode controlled transmission line by manipulating a volume of said conductive fluid;

a controller for controlling said composition processor in response to a transmission line mode control signal; and wherein said structure is comprised of a plurality of fluid conduits, each defining an elongated cavity, and arranged in a row to form an effective waveguide wall.

11. The mode controlled transmission line according to claim 10 wherein said plurality of fluid conduits extend from a first wall of said waveguide to a second wall of said waveguide, said second wall being spaced from said first wall.

12. The mode controlled transmission line according to claim 11 wherein said conductive fluid contained in said plurality of fluid conduits in said first state forms an electrical connection with said first and second walls.

13. A method of controlling the mode of a transmission line comprising the steps of:

providing at least one waveguide cavity at least partially formed of a dielectric material and contained within a waveguide;

at least partially filling said waveguide cavity with a conductive fluid while constraining said conductive fluid with said dielectric material;

propagating said RF signal within said waveguide; and changing at least a volume of said conductive fluid contained within said waveguide cavity to selectively vary at least one of a physical dimension of the waveguide or an electrical dimension of the RF signal in response to a waveguide mode control signal.

14. The method according to claim 13 further comprising the step of constraining said conductive fluid in a portion of said waveguide to modify a cutoff frequency of said waveguide.

15. The method according to claim 13 further comprising the step of constraining said conductive fluid in a portion of said waveguide to modify an electrical length of said waveguide.

16. The method according to claim 13 further comprising the step of constraining said conductive fluid in a plurality of fluid conduits, each defining an elongated cavity, and arranged in a row to form an effective waveguide wall.

17. The method according to claim 16 further comprising the step of forming an electrical connection between said conductive fluid and at least one conductive wall of said waveguide.

18. The method according to claim 13 further comprising the step of constraining said conductive fluid using at least a first solid dielectric wall extending from a first conductive wall of said waveguide to a second conductive wall of said waveguide, said second conductive wall being spaced from said first conductive wall.

19. The method according to claim 18 further comprising the step of constraining said conductive fluid between said first dielectric wall and at least one conductive wall of said waveguide.

20. The method according to claim 19 further comprising the step of constraining said conductive fluid between said first dielectric wall and a second dielectric wall.

21. A method of controlling the mode of a transmission line comprising:

propagating an RF signal within a waveguide;

constraining a conductive fluid in at least one cavity structure that is at least partially formed of a dielectric material contained within said waveguide; and selectively varying a volume of said conductive fluid contained within said cavity structure to control an operational characteristic of said waveguide in response to a waveguide mode control signal.

* * * * *